United States Patent [19]

Peck

[11] 4,324,221

[45] Apr. 13, 1982

[54] ARROW REST FOR ARCHERY BOW

[76] Inventor: Paul L. Peck, Box 427, Bryantville, Mass. 02327

[21] Appl. No.: 166,152

[22] Filed: Jul. 7, 1980

[51] Int. Cl.[3] ..... F41B 5/00

[52] U.S. Cl. ..... 124/24 R; 124/41 A

[58] Field of Search ..... 124/41 A, 24 R, 35 A, 124/88, 25

[56] References Cited

U.S. PATENT DOCUMENTS 3,285,237 11/1966 Wolfe ..... 124/41 A
3,406,675 10/1968 Fredrickson ..... 124/41 A X
3,890,951 6/1975 Jennings et al. ..... 124/41 A
3,935,854 2/1976 Troncosco ..... 124/41 A X

*Primary Examiner*—Richard C. Pinkham
*Assistant Examiner*—William R. Browne
*Attorney, Agent, or Firm*—Richard P. Crowley

[57] ABSTRACT

An improved archery rest in combination with an archery bow. The rest including a shaft and a pair of inwardly biased facing elements slidably mounted on a shaft with inwardly inclined faces. The facing elements move between a rest condition and an outward condition, when an arrow is propelled through the arrow notation areas designed by the facing elements. An archery bow receives the arrow rest in the window thereof.

11 Claims, 3 Drawing Figures

ARROW REST FOR ARCHERY BOW

BACKGROUND OF THE INVENTION

Arrow rests for archery bows are typically connected to the side wall of the bow generally in the window area of the bow and above the bow shelf. The arrow rest is often secured in a rigid fashion to the bow handle and extends generally perpendicularly and outwardly from the side wall of the bow handle. Arrow rests are employed to form a support for an arrow shaft, whereby the arrow shaft may be aimed accurately and shot from the bow. The force of the bow string of an archery bow, in propelling the arrow forward, creates a series of rapidly diminishing flexing and bowing; that is, oscillations, to the arrow shaft, as it passes over the arrow rest. Arrow propulsion thus creates certain downward and lateral forces on the arrow rest and results in reduced accuracy in archery shooting. In addition, the misalignment of the arrow, when it is not exactly initially parallel with the bow side wall, so that the application of force from the string to the arrow is at an angle, also creates vertical and sideward forces which substantially diminsh the accuracy of the arrow and the arrow speed. Further, an arrow rest is susceptible to changes with time, such as the wearing of the surfaces of the arrow, which also creates inaccuracy in archery shooting.

Various archery rest devices have been proposed in the past, in order to overcome some of the problems associated with accurate archery shooting with an archery bow. For example, U.S. Pat. No. 3,865,096, issued Feb. 11, 1975, and U.S. Pat. No. 3,935,854, issued Feb. 3, 1976, relate to archery bows and arrow supports and discuss in general the problems associated with accurate and reproductive shooting of arrows and various factors affecting the flight, accuracy and speed of the arrow. These patents describe various improved archery rests or supports, both generally employing a strip or a pair of strips of spring steel, plastic or the like, in order to provide an archery rest with improved arrow flight without arrow feather interference.

There is a need and a requirement for an archery rest device which will reduce and control, in an accurate and reproducible manner, the vertical and side oscillations of the arrow as it moves through the notch area in the arrow rest, and which arrow rest reduces and controls the various downward and side forces associated with the flight of the arrow and reduces the misalignment of the arrow. Such an improved arrow rest also should be of a type which is simple in construction and which may be employed many times, without affecting the accuracy of the archer.

SUMMARY OF THE INVENTION

My invention relates to an arrow rest for an archery bow and to an archery bow containing such arrow rest.

My invention relates to an improved and a simple arrow rest adapted to be secured to an archery bow, particularly to the side wall or window area of the bow, and which arrow rest provides reciprocating, tensioned, movable means which define an arrow-receiving space or arrow notch therebetween. The reciprocating, movable means are urged together through tension means and are provided with opposing facing surfaces which form the arrow notch area. My improved arrow rest device reduces and controls the vertical, downward and lateral forces of the arrow as it is propelled from the archery bow, by permitting the generally perpendicular, horizontal, outward movement of either one or both of the facing elements, as the arrow moves through the arrow notch, after being propelled from the archery bow. Thus, the downward or lateral, or both, forces of the arrow urge either one or both of the facing elements outwardly from a rest position and aid in absorbing and and diminishing the bowing, flexing and other oscillations of the arrow in flight.

Further, my improved arrow rest device may be formed of a durable material, such as of metal or high-impact plastic material, wherein the facing surfaces of the movable elemens are not subject to rapid wear during continuous use, and, therefore, there is substantially little or no change in accuracy over a period of time due to part wear. My device provides for a means to control the tension applied to the facing elements, so that the amount of tension to force such elements apart, during the arrow flight, may be controlled or adjusted, as desired, by the archer. My arrow rest device also may be provided with an off-center shaft, so that, in use when secured to the archery bow, the arrow to be launched will be positioned in a more normal or lower archery position. Otherwise, my improved arrow device may be secured firmly to the archery bow by screwing into the bow in a generally perpendicular direction in the shelf area, employing a lock nut onto the threaded shaft.

My arrow rest is easily manufactured and is simple in operation, but overcomes many of the problems associated with the archer's paradox and permits long-time, reproducible accuracy in the flight of arrows. My improved archery device absorbs the shock of the downward and lateral movement of the arrow in flight, and permits the movable facing elements on the device to move in response to the downward or lateral thrust of the arrow, and the amount of movement can be controlled by adjusting of the tension means on either side of the movable facing elements. The device typically is composed of a hardened steel shaft, with steel or hardened aluminum, movable facing elements. The use of my improved arrow rest device permits the arrow to be more accurate and more reproducible, in that the arrow leaves the arrow rest in a more identical manner each time.

DESCRIPTION OF THE EMBODIMENTS

Figure 1:
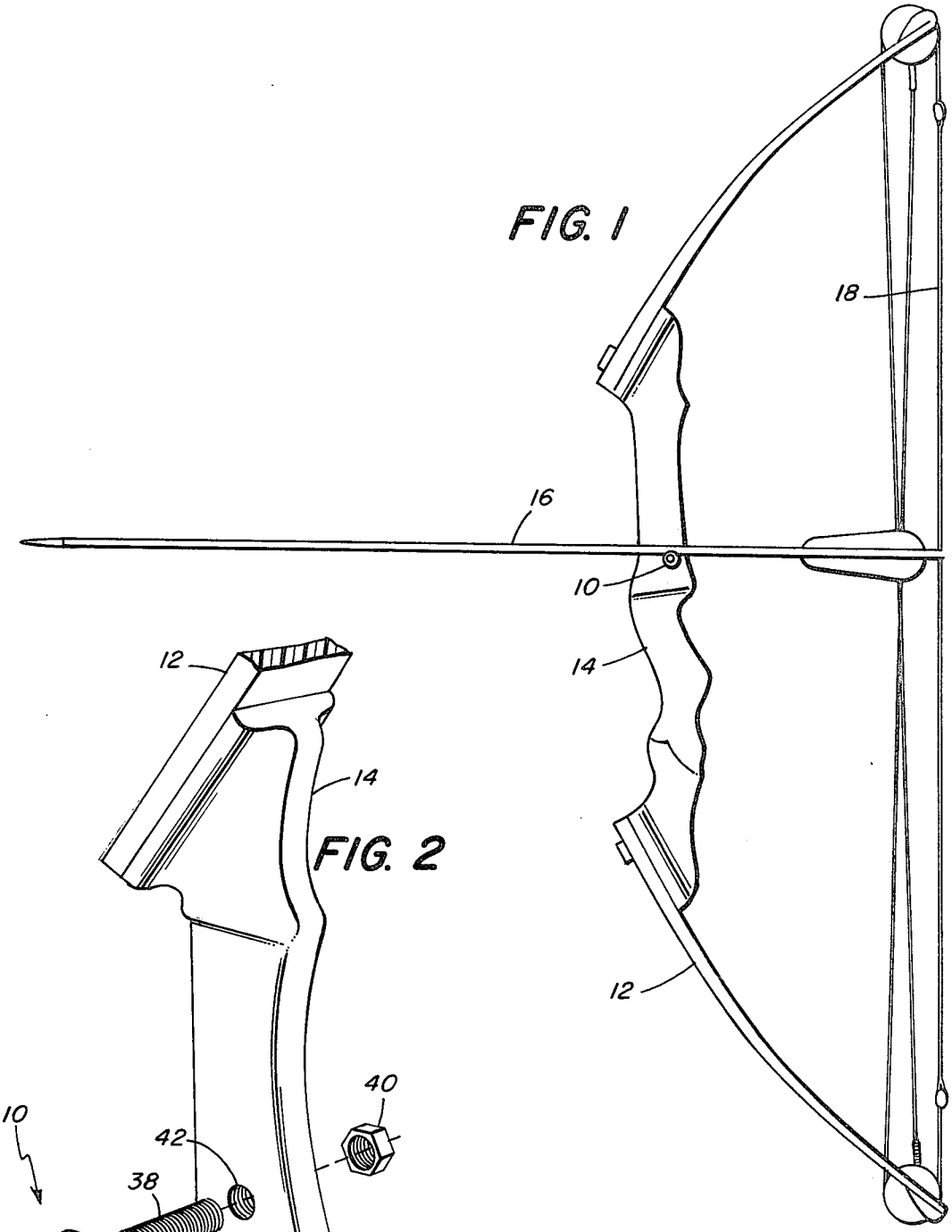
FIG. 1 is a general perspective view of an archery bow having my arrow rest secured thereto.

FIG. 1 shows an archery bow 12 having a string 18 and fitted with an arrow 16, which arrow is to be propelled by the stretching of the string 18, the archery bow having a cutout shelf or window area 14 and includes an arrow rest 10 of my invention secured to the lower portion of the window area.

Figure 2:
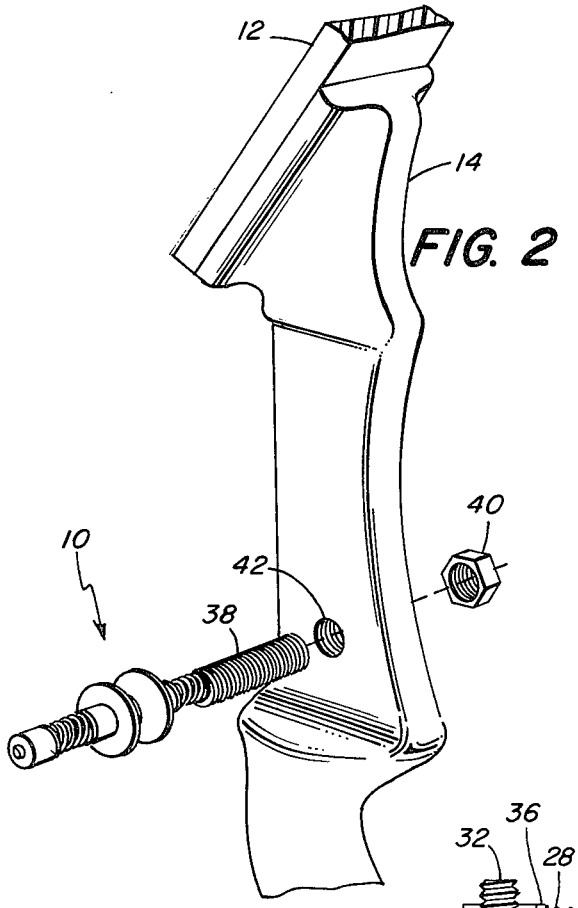
FIG. 2 is an enlarged, fragmentary, schematic, exploded view of my arrow rest in relationship to the bow.

FIG. 2 illustrates the improved arrow rest 10 and the manner of securing the arrow rest 10 through a threaded hole 42 in the shelf area 14, wherein one threaded end 38 of the arrow rest is secured by a threaded lock nut 40 in a generally perpendicular direction extending from the window area 14.

Figure 3:
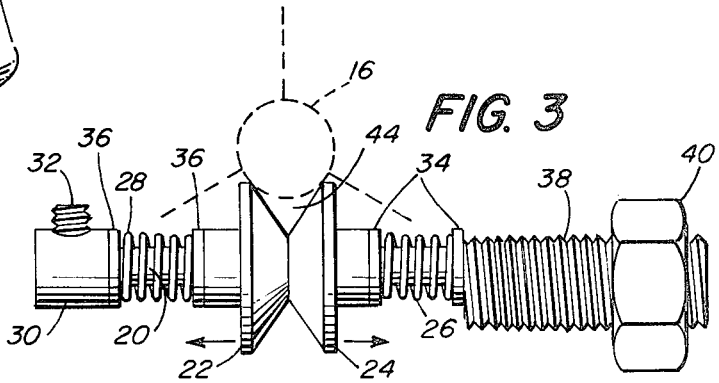
FIG. 3 is a side elevational view of my arrow rest.

FIG. 3 shows the arrow rest 10, with the arrow 16 shown in dotted lines, which arrow rest comprises a hardened steel shaft 20 having a smooth surface and axially secured to a threaded shaft 38, the hardened steel shaft 20 slightly offset from the axis of the shaft 38, so that the arrow may sit lower than the axis of the shaft 38. Two aluminum facing elements 22 and 24, having opposing facing threaded surfaces, form a generally conical arrow notch area 44. The facing surface elements 22 and 24 are slidably and rotatably mounted about and on the shaft 20. A pair of coil or helical springs 26 and 28 are disposed about the shaft 20, one on each side of the elements 22 and 24. A retainer 30 is placed at one end of shaft 20 and has a set screw 32, whereby the retainer may be moved adjustably along the shaft 20 and secured in place by the set screw 32, to adjust the tension of the spring elements 26 and 28. Synthetic washer elements, composed of a plastic or elastomeric material 34 and 36, are disposed on either side of the coil springs 26 and 28. A threaded nut 40 is adapted to be secured at one end of the threaded shaft 38, which shaft secures the arrow rest through passageway 42 to the window area of the archery bow.

The arrow-receiving area or the arrow notch area 44 is schematically represented as being generally conical in shape as formed by the generally conical facing surfaces of the slidably and rotatably mounted elements 22 and 24 on the offset smooth shaft 20. However, the opposing facing surfaces may be of various shapes and contours and tapered, to define an arrow notch area of desired configuration. Typically, the smooth shaft 20 and the threaded shaft 38 should be composed of a hardened metal material, in order to withstand the downward and lateral movement and shock of the arrow in flight, while the movable conical elements may be formed of a light-weight metal, such as aluminum, coated or uncoated, such as to present a hard, durable, nonwearing surface; therefore, assuring continued arrow accuracy with long use.

An elongated bracket may be used and disposed on the opposite side of the passageway 42 or other extension means used to set and position the arrow rest 10 lower or higher than, or offset from, the axis of the passageway 42. In addition, the shaft element 20 has been illustrated as a straight, single shaft; however, the shaft 20 may comprise a split or Y-type shaft, with the facing elements 22 and 24 on either axis of the split shaft.

In operation, the arrow 16 is propelled forward by the taut, forward movement of the string 18 of the archery bow 12, and, with such forward movement, the arrow 16 creates downward and lateral side forces, either due to the diminishing flexibility and oscillations of the arrow in flight, or due to possible misalignment of the arrow by the archer in use. The downward or lateral force of the arrow in flight, against one or both of the facing surfaces of the movable elements 22 and 24, forces the elements apart against the coil-spring tension means 26 adjusted or selected to provide for the desired amount of such force. The outward movement of the conical elements 22 and 24, slidably mounted on the shaft, by the flight of the arrow, helps to absorb downward and lateral forces of the arrow in flight, and, therefore, increases the accuracy and reproducibility of the arrow in flight, as well as improving the arrow speed.

My invention has been described and illustrated in connection with the preferred embodiment; however, it is recognized that various changes and modifications may be made to my arrow rest, as shown and described, all falling within the spirit and scope of my invention.

What I claim is:

1. An arrow rest for use with an archery bow having a window area, the arrow rest adapted to receive an arrow, and which arrow rest comprises:

(a) a first shaft element adapted to be secured to the archery bow about the window area and to extend generally perpendicularly therefrom;

(b) first and second facing elements slidably mounted for axial, reciprocating movement on the first shaft element, the first and second elements having opposing facing surfaces which define an arrow-receiving notch therebetween, to support an arrow to be propelled by the archery bow;

(c) tension means to bias and urge the first and second facing elements toward each other; and (d) means to secure the shaft element to the window area of the archery bow, whereby shocks and vibrations occasioned by the vertical and lateral movements of the arrow, during release of the arrow from the bow, will be dampened, as the arrow passes through the arrow-receiving notch of the arrow rest through outward movement of the biased facing elements on the shaft.

2. The arrow rest of claim 1 wherein the first and second facing elements have generally identical, tapered facing surfaces.

3. The arrow rest of claim 2 wherein the first and second facing elements have identical, generally straight, tapered surfaces, which tapered surfaces form a generally conical arrow-receiving notch area.

4. The arrow rest of claim 1 wherein the tension means comprises first and second coil springs, the first spring disposed on one side and the second spring disposed on the other respective side of the first and second facing elements and about the shaft, the coil springs biasing the two facing elements into a close, contacting relationship, to form the arrow-receiving notch area.

5. The arrow rest of claim 1 which includes a retainer means positioned at one end of the first shaft, to retain the tension means at the desired tension.

6. The arrow rest of claim 5 wherein the retainer means includes an adjustable retainer about the shaft element with an adjustable set screw therein, the retainer positioned at the one end of the first shaft element, whereby the position of the retainer, as secured by the set screw, controls the amount of tension urging the two facing elements into a close, contacting relationship.

7. The arrow rest of claim 1 wherein the means to secure the first shaft element includes a second shaft element secured to and axially aligned with the first shaft element, and a means to secure the one end of the shaft element to the archery bow.

8. The arrow rest of claim 7 wherein the second shaft element is a threaded shaft of a larger diameter than the first shaft element, and the first shaft element is secured offcenter from the axis of the second shaft element.

9. The arrow rest of claim 1 wherein the first and second facing elements are composed of aluminum, and the first shaft is composed of a hardened steel having a smooth exterior surface.

10. An archery bow composed of a bow and an archery string, the archery bow characterized by a cutout window area therein, and which includes an arrow rest having;

(a) a first shaft element adapted to be secured to the archery bow about the window area and to extend generally perpendicularly therefrom;

(b) first and second facing elements slidably mounted for axial, reciprocating movement on the first shaft element, the first and second elements having opposing facing surfaces which define an arrow-receiving notch therebetween, to support an arrow to be propelled by the archery bow;

(c) tension means to bias and urge the first and second facing elements toward each other; and (d) means to secure the shaft element to the window area of the archery bow, whereby shocks and vibrations occasioned by the vertical and lateral movements of the bow, during release of the arrow from the bow, will be dampened, as the arrow passes through the arrow-receiving notch of the arrow rest through outward movement of the biased facing elements on the shaft;

(e) said arrow rest being secured to the window area and the first shaft element extending generally perpendicularly to said window area

11. An arrow rest for use with an archery bow having a window area to receive an arrow, which arrow rest comprises:

(a) a first shaft element having a smooth exterior surface and adapted to be secured to the archery bow about the window area and to extend generally perpendicularly therefrom;

(b) first and second facing elements rotatably slidably mounted for axial reciprocating and rotating movement on the first shaft element, the first and second facing elements having generally identical, opposing facing surfaces with a generally tapered surface which defines a generally conical arrow-receiving notch area therebetween;

(c) first and second springs positioned on either side of the first and second facing elements and about the first shaft element, the first and second springs biasing the respective facing elements toward each other while at rest;

(d) a second shaft element at the one end secured to and extending axially from the first shaft element and adapted to secure the first shaft element to the window area of the archery bow;

(e) a retainer means at the one end of the first shaft element adapted to retain the first or second coil spring in position and to adjust the amount of tension to urge the facing elements together by the position of the retainer means at the end of the first shaft element; and (f) means to secure the other end of the second shaft element to the archery bow.

* * * * *